US005784673A

United States Patent [19]

Terada et al.

[11] Patent Number: 5,784,673

[45] Date of Patent: Jul. 21, 1998

[54] IMAGE FORMING APPARATUS HAVING A TONER BRUSH EQUIPPED WITH A TOUGHENING MEMBER FOR MATERIALS OF THE BRUSH

[75] Inventors: Takashi Terada; Masaru Watanabe; Hiroyuki Hazama, all of Osaka, Japan

[73] Assignee: Mita Industrial Co., Ltd., Osaka, Japan

[21] Appl. No.: 751,942

[22] Filed: Nov. 19, 1996

[30] Foreign Application Priority Data

Nov. 29, 1995 [JP] Japan ..... 7-311284

[51] Int. Cl.[6] ..... G03G 15/24; G03G 21/00

[52] U.S. Cl. ..... 399/149; 15/256.5; 399/150; 399/343

[58] Field of Search ..... 399/98, 148, 150, 399/343, 411; 15/256.5–256.52

[56] References Cited

U.S. PATENT DOCUMENTS

| | | | |
|---|---|---|---|
| 5,055,882 | 10/1991 | Fushimi | 399/150 |
| 5,200,789 | 4/1993 | Oshiumi | 399/150 X |
| 5,245,386 | 9/1993 | Asano et al. | 399/175 |
| 5,436,700 | 7/1995 | Kikuchi et al. | 399/98 X |
| 5,479,244 | 12/1995 | Kashihara et al. | 399/175 |
| 5,497,224 | 3/1996 | Ishikawa et al. | 399/150 X |
| 5,568,232 | 10/1996 | Kashihara | 361/221 X |
| 5,587,774 | 12/1996 | Nagahara et al. | 399/150 X |
| 5,610,697 | 3/1997 | Arai | 399/149 |

FOREIGN PATENT DOCUMENTS

| | | |
|---|---|---|
| 649073 | 4/1995 | European Pat. Off. . |
| 5-94113 | 4/1993 | Japan . |

OTHER PUBLICATIONS

European Search Report No. 96118852.1 and Annex completed Mar. 19, 1997.

*Primary Examiner*—William J. Royer

*Attorney, Agent, or Firm*—Beveridge, DeGrandi, Weilacher & Young, LLP

[57] ABSTRACT

According to the present invention, in the image forming apparatus in which so-called "cleaningless" is realized, no problems such as traces of paper powder, gray or foggy stripes and the like occur in a formed image. The image forming apparatus is provided with a brush for scratching toner remaining on the surface of the photosensitive drum and recovering paper powder adhering on the surface thereof. When the length of the brush extending from the root thereof to the photosensitive drum is taken as a[mm], the length of the toughening member, toughening the brush materials, projecting from the root of the brush materials is taken as c[mm], and the length of the portion of the brush, cutting into the photosensitive drum, is taken as b[mm], the relationship among a[mm], b[mm] and c[mm] satisfies the conditions that $0.3 \leqq (c/(a+b)) \leqq 0.95$, $0.1$ [mm]$\leqq b \leqq 1.5$ [mm], and $(a+b)<2$ [mm].

4 Claims, 5 Drawing Sheets

IMAGE FORMING APPARATUS HAVING A TONER BRUSH EQUIPPED WITH A TOUGHENING MEMBER FOR MATERIALS OF THE BRUSH

BACKGROUND OF THE INVENTION

1. Field of the Invention

The present invention relates to an electrostatic type image forming apparatus such as a copying machine, a printer or a facsimile of an electrostatic type. Particularly, it relates to a so-called cleaningless image forming apparatus so adapted that a developer remaining after transfer is recovered by a developing device.

2. Description of the Prior Art

An electrostatic type image forming apparatus using non-magnetic single component toner as a developer has been conventionally known. In such an apparatus, a contact development system in which a developing roller is used for developing an electrostatic latent image formed on a photosensitive drum, and the developing roller is brought into contact with the surface of the photosensitive drum has been employed. A toner image obtained by the development is transferred to paper from the surface of the photosensitive drum. However, residual toner adheres on the surface of the photosensitive drum after the transfer. In many cases, the residual toner is recovered by a cleaning device. On the other hand, some so-called cleaningless structures in which the cleaning device is omitted have been known.

In the case of the cleaningless image forming apparatus, the residual toner remaining on the surface of the photosensitive drum after the transfer is recovered by a developing device when it is brought into contact with the developing device.

However, in many cases, the toner is rigidly electrostatically coupled to charge on the surface of the photosensitive drum. Therefore, it is difficult to satisfactorily recover all of the residual toner by the developing device.

Even if the residual toner is recovered by the developing device, paper powder sucked from the paper adheres on the surface of the photosensitive drum. As the number of copies is increased, the amount of paper powder adhering on the surface of the photosensitive drum is increased, whereby a pixel's dropped portion, for example, shielded by the paper powder becomes remarkable on a copy image.

Even if the cleaning device for the residual toner is omitted, therefore, the necessity of providing a new device for removing the paper powder adhering on the surface of the photosensitive drum has been pointed out.

SUMMARY OF THE INVENTION

The present invention has been made under such a background and provides an image forming apparatus in which so-called "cleaningless"0 is realized with respect to residual toner, wherein paper powder adhering on the surface of a photoreceptor can be recovered, so that no problems such as traces of paper powder occur in a formed image.

In accordance with an aspect, the present invention is directed to an image forming apparatus comprising a photosensitive drum in a drum shape, having a photosensitive layer on its surface, and rotated at the time of its operation, an electrostatic latent image forming device for forming an electrostatic latent image on the surface of the photosensitive drum, a developing device for developing the formed electrostatic latent image by toner, a transferring device for transferring a toner image obtained by the development to a predetermined sheet, and a brush in contact with the surface of the photosensitive drum after the transfer for scratching toner remaining on the surface thereof and recovering paper powder adhering on the surface thereof.

In accordance with a preferable aspect, the present invention is directed to an image forming apparatus wherein a portion having a length of b [mm] on the side of the tip of the brush cuts into the surface of the photosensitive drum when the length of a lot of fine brush materials studded on the brush is taken as (a+b) [mm], and the brush materials comprise a toughening member for regulating the curvature of the brush materials, the toughening member extending to a length of c [mm] from the root of the brush materials, the relationship among the a [mm], b [mm] and c [mm] satisfying the following conditions:

$$0.3 \leqq (c/(a+b)) \leqq 0.95, \text{ and}$$

$$0.1[\text{mm}] \leqq b \leqq 1.5[\text{mm}]$$

In accordance with another aspect, the present invention is characterized in that in the above-mentioned image forming apparatus, the a [mm] and b [mm] further satisfy the following condition:

$$(a+b) \leqq 2[\text{mm}]$$

According to the above-mentioned structure, the paper powder can be efficiently recovered by the brush materials. Moreover, the developer can satisfactorily slip off between the brush materials.

Therefore, no problems such as traces of paper power occur in the formed image. Moreover, no gray or foggy stripes or the like appear in the formed image by the developer adhering on the brush.

Furthermore, the above-mentioned image forming apparatus is characterized in that the developing device has a function of recovering the unnecessary toner, which is to be scratched by the brush, remaining on the surface of the photosensitive drum.

Additionally, the above-mentioned image forming apparatus is characterized in that the toner is non-magnetic single component toner.

According to each of the above-mentioned structures, the paper powder adhering on the surface of the photosensitive drum can be satisfactorily recovered by the brush. Further, the brush also has a function for scratching the toner remaining on the surface of the photosensitive drum. Therefore, the scratched toner is efficiently recovered when it is brought into contact with the developing device.

Particularly, the present invention effectively functions in a case where the toner is non-magnetic single component toner.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
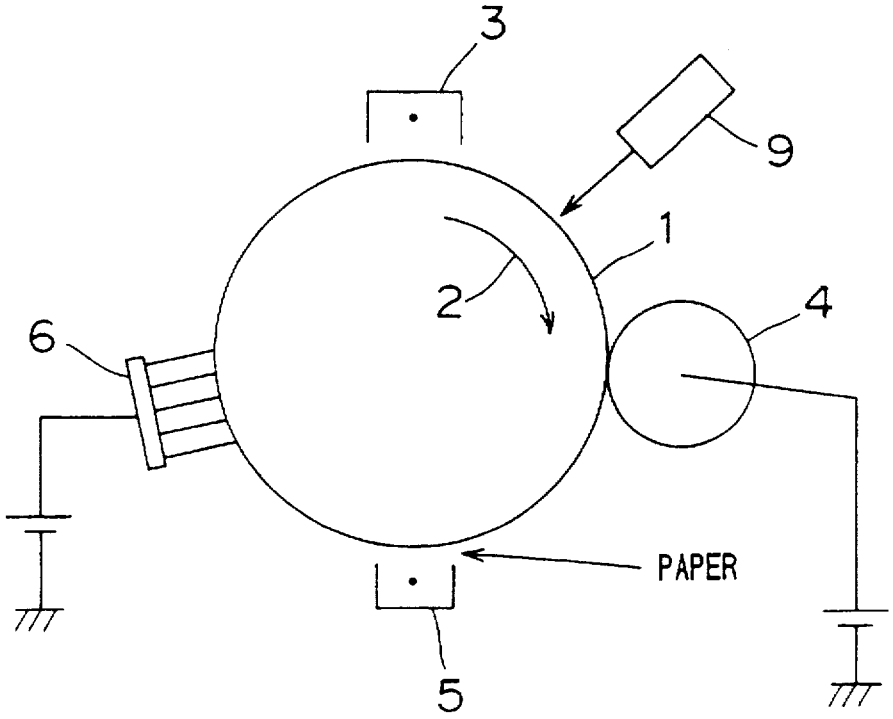
FIG. 1 illustrates the outline of an image forming apparatus according to one embodiment of the present invention which is a contact development system using non-magnetic single component toner as a developer and using a developing roller, and is so-called cleaningless.

Referring now to the drawings, embodiments of the present invention will be specifically described.

FIG. 1 illustrates the outline of an image forming apparatus according to one embodiment of the present invention. The apparatus shown in FIG. 1 is a contact development system using non-magnetic single component toner as a developer and using a developing roller and is so-called cleaningless.

The photosensitive drum 1 is rotated at a predetermined speed in a direction indicated by an arrow 2. A main charger 3, an exposing device 9, a developing roller 4, a transferring corona discharger 5, and a brush 6 are arranged along the rotational direction 2 of the photosensitive drum 1 around the photosensitive drum 1. The surface of the photosensitive drum 1 is charged to a predetermined potential by discharges in the main charger 3. When the photosensitive drum 1 is rotated in the direction indicated by the arrow 2, the charged surface is exposed to light corresponding to an image by the exposing device 9. Consequently, an electrostatic latent image is formed on the surface of the photosensitive drum 1. When the photosensitive drum 1 is further rotated, the electrostatic latent image on the surface thereof is brought into contact with the developing roller 4, and is developed by the nonmagnetic single component toner. A toner image is transferred to fed paper when it is in a position opposite to the transferring corona discharger 5. Residual toner generally adheres on the surface of the photosensitive drum 1 after the transfer. Further, paper powder from the paper adheres thereon. The brush 6 is provided for scratching the residual toner adhering on the surface of the photosensitive drum 1 and recovering the paper powder. Further, the brush 6 is biased with a predetermined potential in order to enhance an effect of scratching the toner and improving the efficiency of recovery of the paper powder.

In this specification, "scratch" means as follows; the brush 6 not only physically scratching the residual toner, but also eliminating the static charge adhering on the residual toner because it is biased with a predetermined potential. As a result, scratching makes a state weakened, whereby the charge on the surface of the photosensitive drum I and the toner are rigidly electrostatically coupled to each other on the surface of the photosensitive drum 1. When the brush 6 scratches the toner, the slight residual toner adheres on the brush 6. This adhesion is caused not as a result of an attempt to positively adsorb the toner by the brush 6 but naturally because the brush 6 is in contact with the surface of the photosensitive drum 1, unlike the adsorption of the paper powder.

The surface of the photosensitive drum 1 which has passed through the brush 6 is in a state where electrostatic coupling between the charge on the surface of the photosensitive drum 1 and the toner is weakened, so that toner particles loosely electrostatically adhere on the surface of the photosensitive drum 1.

When the surface of the photosensitive drum 1 in the above-mentioned state is positioned opposite to the main charger 3, the surface of the photosensitive drum 1 is charged to a predetermined high potential again by the main charger 3. The surface of the photosensitive drum 1 is exposed to light corresponding to an image by the exposing device 9, so that the photosensitive drum 1 is moved to the developing roller 4. In this case, the residual toner is scratched by the brush 6, also, the amount of the residual toner remaining on the surface of the photosensitive drum 1 is very small. When the surface of the photosensitive drum 1 is charged again and is exposed by the exposing device 9, therefore, the residual toner does not disturb the formed electrostatic latent image.

When the residual toner on the photosensitive drum 1 reaches the developing roller 4, the residual toner is drawn toward the developing roller 4 by a Coulomb force produced from the difference between the bias applied to the developing roller 4 and the surface potential of the photosensitive drum 1, whereby the residual toner is recovered. At the same time, the developing roller 4 develops the electrostatic latent image into a toner image.

As described in the foregoing, the paper powder is recovered by the brush 6. Further, the residual toner is scratched by the brush 6. As a result, the residual toner is satisfactorily recovered by the developing roller 4.

Figure 2:
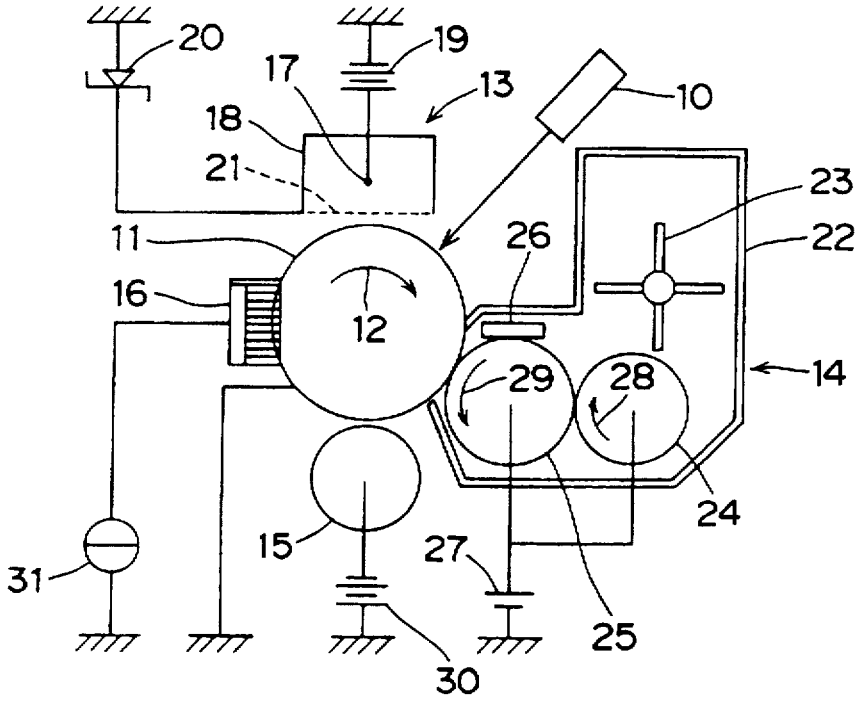
FIG. 2 is a schematic diagram showing the construction of an image forming apparatus according to another embodiment of the present invention.

FIG. 2 is a schematic diagram showing the construction of an image forming apparatus according to another embodiment of the present invention. The image forming apparatus comprises a photosensitive drum 11. The photosensitive drum 11 is rotated at a predetermined speed in a direction indicated by an arrow 12. A main charger 13, an exposing unit 10, a developing device 14, a transferring roller 15, and a brush 16 are arranged in this order along the rotational direction indicated by the arrow 12 around the photosensitive drum 11.

The main charger 13 is a discharger for charging the surface of the photosensitive drum 11 to a predetermined high potential (for example, +800 V). The main charger 13 comprises a discharge wire 17 and a shielding case 18. A voltage from a high-voltage DC unit 19 is applied to the discharge wire 17. Further, an opening, which is positioned opposite to the surface of the photosensitive drum 11, of the shielding case 18 comprises a grid 21 connected to a voltage regulating diode 20 in order to control a potential obtained by discharges in the discharge wire 17.

The surface of the photosensitive drum 11 is charged to a predetermined high potential by being positioned opposite to the main charger 13, whereby a charged region is moved in a clockwise direction as the photosensitive drum 11 is rotated. The charged surface of the photosensitive drum 11 is exposed to light produced on the basis of image data outputted from the exposing unit 10. A portion which is exposed to light is brought into a low potential because charge in the portion escapes. Consequently, an electrostatic latent image which is constituted by a high potential region and a low potential region is formed on the surface of the photosensitive drum 11.

When the photosensitive drum 11 is further rotated, so that the electrostatic latent image reaches the developing device 14, the electrostatic latent image is developed into a toner image by the developing device 14.

The developing device 14 comprises a housing 22, an agitating blade 23 provided in the housing 22, a sub-roller 24, a developing roller 25 arranged so as to come into contact with the sub-roller 24 and the photosensitive drum 11, and a toner regulating plate 26 arranged along a peripheral surface of the developing roller 25.

The agitating blade 23 is for agitating toner in the housing 22 so that the toner is uniformly supplied to the sub-roller 24 and the developing roller 25.

The sub-roller 24 and the developing roller 25 are respectively rotated in directions indicated by arrows 28 and 29, and the toner is frictionally charged by the rotation to electrostatically adsorb the toner on their peripheral surfaces. The sub-roller 24 is provided for frictionally charging the toner more effectively.

In the present embodiment, non-magnetic single component toner is used, and no so-called carrier is included.

The toner adhering on the peripheral surface of the developing roller 25 is regulated as a thin layer by the toner regulating plate 26. Consequently, the toner adhering on the peripheral surface of the developing roller 25 becomes uniform, whereby nonuniformity in the development is eliminated. Further, the developing roller 25 is so rotated that its peripheral speed is higher than the peripheral speed of the photosensitive drum 11 to prevent the transferred toner from being insufficient.

Furthermore, a predetermined bias voltage is applied to the sub-roller 24 and the developing roller 25. Specifically, a bias voltage of +300 V, for example, is applied by a DC power supply 27. Consequently, suitable development is performed. More specifically, the surface potential of the photosensitive drum 11 is a low potential VL in an exposed portion, while being a high potential VH in the other portion. On the other hand, the developing roller 25 is charged to a positive potential VM by a developing bias voltage. The potential VM of the developing roller 25 (for example, +300 V) is made lower than the high potential VH (for example, +800 V) in the unexposed region on the surface of the photosensitive drum 11, and is made higher than the low potential VL (for example, +100 V) in the exposed region. Accordingly, the toner adhering on the surface of the developing roller 25 is electrostatically adsorbed only on the exposed region on the surface of the photosensitive drum 11, whereby development is performed.

Paper is fed from a conveying path (not shown) as an end of the toner image on the surface of the photosensitive drum 11 is positioned opposite to the transferring roller 15. The paper is passed between the photosensitive drum 11 and the transferring roller 15. The transferring roller 15 is connected to a high-voltage DC unit 30, and a negative potential is applied to the transferring roller 15. Therefore, paper whose reverse surface is in contact with the transferring roller 15 is charged to a negative potential, whereby the potential on the paper decreases the surface potential of the photosensitive drum 11. Further, the toner on the surface of the photosensitive drum 11 positively charged is transferred to the paper which is charged to a negative potential.

The surface of the photosensitive drum 11 on which the toner has been transferred should ideally enter a state where no toner exists. However, the surface of the photosensitive drum 11 is actually in a state where some residual toner which has not been transferred still adheres. Further, the paper is brought into contact with the surface of the photosensitive drum 11, whereby paper powder or the like produced from the paper, along with the residual toner, also adheres on the surface of the photosensitive drum 11.

In a region on which the residual toner adheres on the photosensitive drum 11, the residual toner is scratched when the region passes through the brush 16, whereby electrostatic coupling between the residual toner and the surface of the photosensitive drum 11 is weakened. Further, the brush 16 is biased with a predetermined current by a constant-current power supply 31 in order that the electrostatic coupling between the residual toner and the surface of the photosensitive drum 11 may be weakened. The bias helps the brush 16 to adsorb the paper powder adhering on the surface of the photosensitive drum 11 as well as to prevent the toner adhering on the brush 16 from being adsorbed by the photosensitive drum 11 again.

Description is now made of the construction of the brush 16 employed in the image forming apparatus according to the present embodiment.

Figure 3:
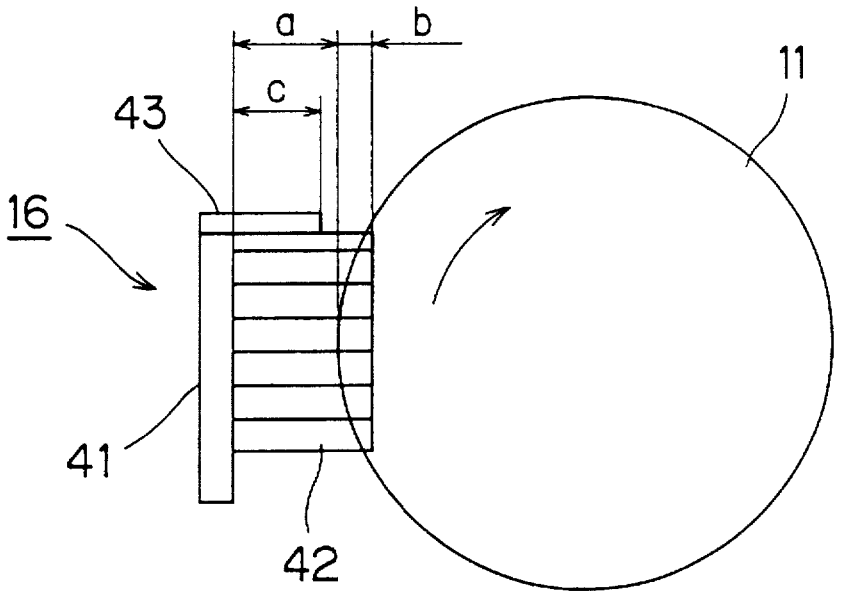
FIG. 3 is a diagram for explaining the construction of a brush provided in the image forming apparatus according to the present embodiment.

FIG. 3 is an illustration showing the construction of the brush 16. In order that the brush 16 recovers the paper powder, the paper powder adhering on the surface of the photosensitive drum 11 must be efficiently scratched off by a lot of fine brush materials 42 studded on a base 41. At this time, when the brush materials 42 are too strongly applied to the photosensitive drum 11, the brush materials 42 are bent in a direction tangential to the photosensitive drum 11, whereby the efficiency of adsorption of the paper powder is reduced. On the other hand, when the brush materials 42 are weakly applied thereto, the paper powder adhering on the photosensitive drum 11 is not adsorbed by the brush materials 42, whereby the paper powder slips off between the brush materials 42. As a result, the capability of the brush materials 42 to recover the paper powder are decreased.

Furthermore, suitable toughness is required for the brush materials 42. When the brush materials 42 are not suitably tough, the paper powder also slips off between the brush materials 42.

The recovery of toner by the brush materials 42 will be described. There exist the conditions under which a lot of toner is recovered as well as paper powder is recovered depending on the conditions under which the brush materials 42 are applied to the photosensitive drum 11. When the brush materials 42 recover a lot of toner, the toner recovered by the brush materials 42 is adsorbed on the surface of the photosensitive drum 11 again, whereby gray or foggy stripes or the like along traces of the brush appear in an image.

The brush 16 must be so adapted that paper powder can be recovered (scratched off) most efficiently, but the toner is only scratched, not scratched off, so that the toner can successfully slip off between the brush materials without being adsorbed by the brush materials 42.

In the present embodiment, when the length of the brush materials 42 is taken as (a+b) [mm], portions having a length of b [mm] on the side of the tips of the brush materials 42 cut into the photosensitive drum 11. Further, the brush materials 42 are provided with a toughening member 43 for toughening the brush materials 42. The toughening member 43 is affixed to a portion, toward which the brush materials 42 are made to flex by the rotation in a clockwise direction of the photosensitive drum 11, of the brush 16. Specifically, the toughening member 43 is fixed to an upper edge of the base 41 in FIG. 3. The toughening member 43 is so adapted that the length of its portion projected from the root of the brush materials 42 is c.

The relationship among the above-mentioned a [mm], b [mm] and c [mm] is set as follows:

$$0.3 \leqq (c/(a+b)) \leqq 0.95$$

$$0.1[\mathrm{mm}] \leqq b \leqq 1.5[mm]$$

where a+b≦2[mm]. This is preferable for lengthening the life of recovery of the paper powder by the brush 16.

Description is now made of grounds on which the above-mentioned conditions are obtained.

In the image forming apparatus shown in FIG. 2, it is examined how much paper powder should enter the developing device 14 in order that traces of paper powder occur in an image. As a result, the following are found:

2 (mg)≦the amount of paper powder : traces of paper powder occur in an image.

1.5(mg)≧the amount of paper powder : no traces of paper powder occur in an image.

As can be seen from the foregoing results, the amount of paper powder included in the developing device 14 must be suppressed to not more than 2 (mg).

The relationship between the proportion among (a+b), b and c in the brush 16 and the amount of paper powder entering the developing device 14 is then examined. As a result, data shown in FIGS. 4 and 5 are obtained.

Figure 4:
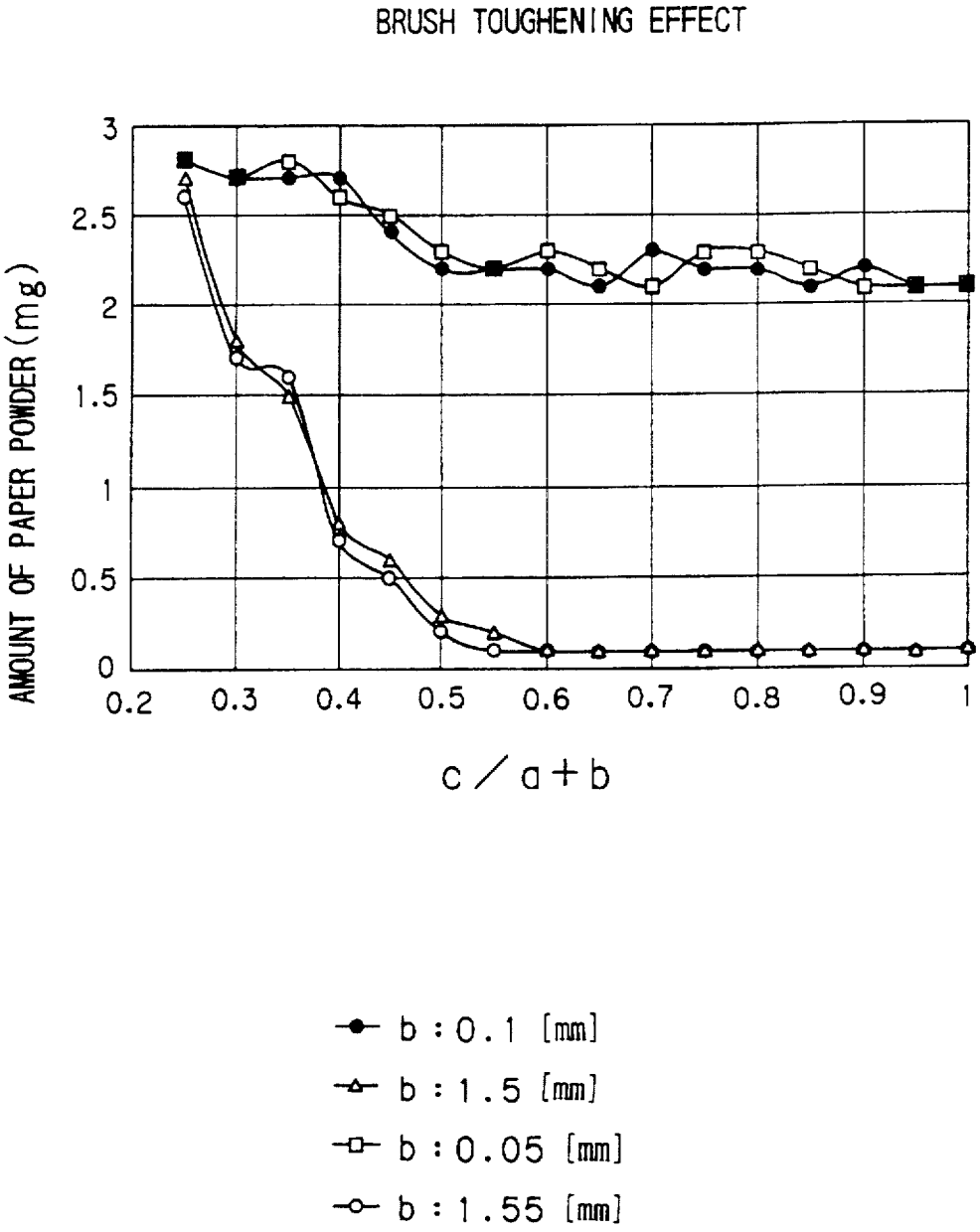
FIG. 4 presents graphs showing a confirmed effect of toughening the brush.

FIG. 4 illustrates the relationship between the amount of paper powder entering the developing device 14 and c /(a+b) in the brush 16. Four graphs in FIG. 4 indicate data in cases where the value of b [mm] in the brush 16 is changed.

Figure 5:
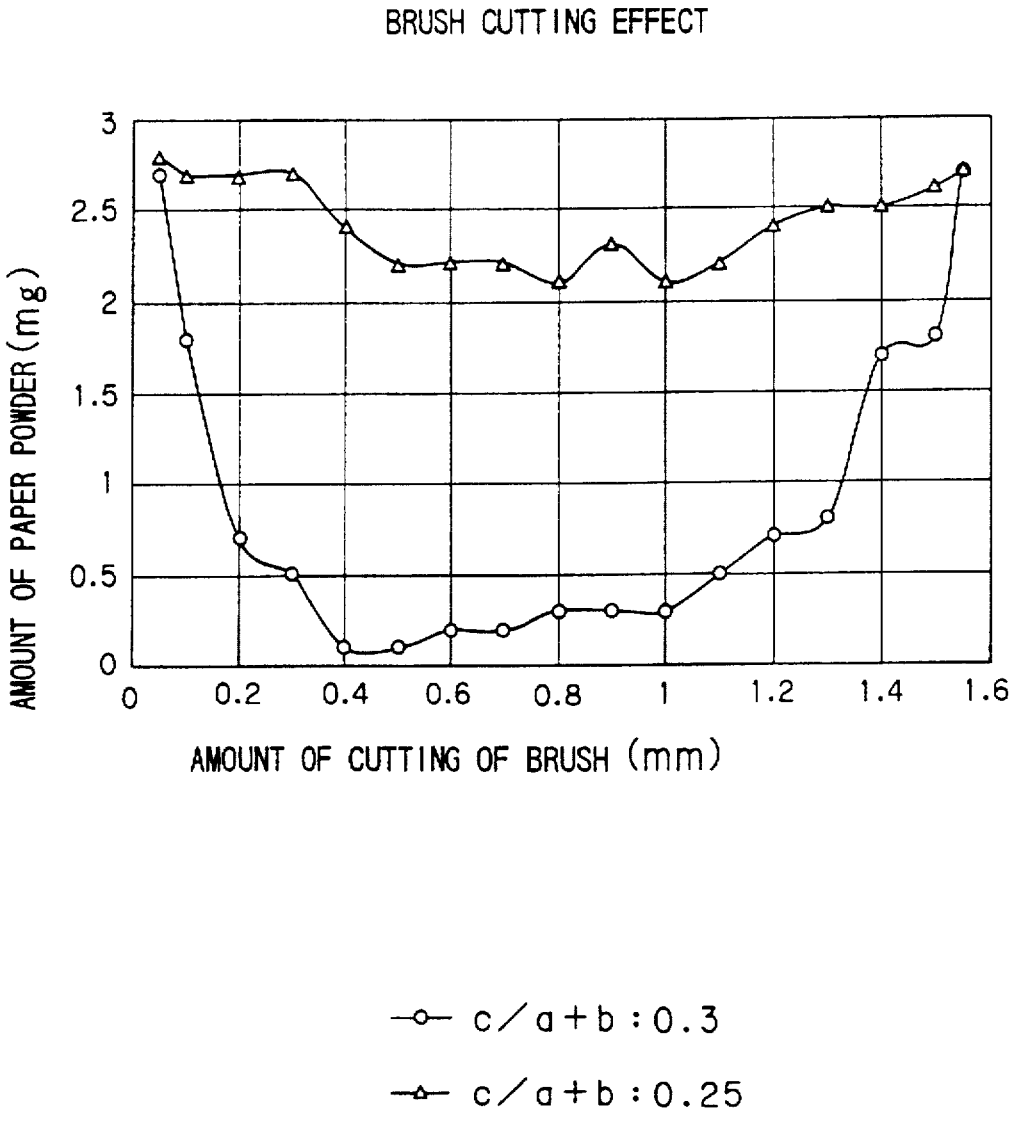
FIG. 5 presents graphs showing a confirmed effect of the amount of cutting of the brush.

FIG. 5 illustrates the relationship between the amount of paper powder entering the developing device 14 and the amount b [mm] of cutting of the brush 16. Two graphs in FIG. 5 indicate data in cases where the value of c /(a+b) in the brush 16 is changed.

As can be seen from FIGS. 4 and 5, the conditions under which the amount of paper powder entering the developing device 14 is less than 2 mg are as follows:

$$0.3 \leqq (c/(a+b)), \text{ and}$$

$$0.1[\text{mm}] \leqq b \leqq 1.5[\text{mm}]$$

Under the above-mentioned conditions, the paper powder can be satisfactorily recovered by the brush 16, and the rate of entrance of the paper powder into the developing device 14 is decreased, whereby it is possible to perform such development that no traces of paper powder occur.

When in the brush 16, the brush materials 42 are too strongly applied to the photosensitive drum 11, and the brush materials 42 are too tough, however, the toner is also recovered by the brush materials 42. The toner recovered by the brush materials 42 adheres on the photosensitive drum 11 again, whereby gray or foggy strips or the like appear. Therefore, conditions related thereto are also examined. The results thereof are as follows:

It is first examined how much toner must adhere on the brush 16 in order that gray or foggy stripes appear as traces of the brush in an image. As a result, it is found that when the amount of toner adhering on the brush 16 becomes 30 mg, gray or foggy stripes appear as traces of the brush on the photosensitive drum 11.

The results obtained by examining the brush conditions and the recovery of the toner will be shown in Table 1:

TABLE 1

| c/a + b | b [mm] | amount of recovery of toner (mg) |
|---|---|---|
| 0.3 | 1.8 | 33 |
| 0.95 | 1.5 | 18 |
| 0.98 | 0.1 | 34 |

As can be seen from Table 1, proper conditions for causing the toner to slip off between the brush materials 42 are the following conditions:

$$(c/(a+b)) \leqq 0.95$$

$$b \leqq 1.5$$

Accordingly, it is found that the above-mentioned conditions of (a+b), b and c in the brush 16 are as follows by combining the conditions and the above-mentioned brush conditions for recovering the paper powder:

$$0.3 \leqq (c/(a+b)) \leqq 0.95, \text{ and}$$

$$0.1[\text{mm}] \leqq b \leqq 1.5[\text{mm}]$$

The recovery capability is confirmed in this experiment on condition that 10,000 images are formed in the image forming apparatus shown in FIG. 2. Further, the amounts of recovery of the paper powder and the toner are measured using an electronic balance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a photosensitive drum having a photosensitive layer on its surface, and being rotated at the time of its operation;

electrostatic latent image forming means for forming an electrostatic latent image on the surface of the photosensitive drum;

developing means for developing a formed electrostatic latent image with toner;

transferring means for transferring a toner image obtained by development to a predetermined sheet member; and a brush provided in contact with the surface of the photosensitive drum after toner image transfer for scratching toner remaining on the surface thereof and recovering paper powder adhering on the surface thereof, wherein a portion having a length of b [mm] on the side of the tip of the brush cuts into the surface of the photosensitive drum when the length of many fine brush materials studded on the brush is taken as (a+b) [mm], and the brush materials comprise a toughening member for regulating the curvature of the brush materials, the toughening member extending to a length of c [mm] from the root of the brush materials, the relationship among a [mm], b [mm] and c [mm] satisfying the following conditions:

$$0.3 \leqq (c/(a+b)) \leqq 0.95, \text{ and}$$

$$0.1\ [\text{mm}] \leqq b \leqq 1.5\ [\text{mm}].$$

2. The image forming apparatus according to claim 1, wherein a [mm] and b [mm] further satisfy the following condition:

$$(a+b) \geqq 2\ [\text{mm}].$$

3. The image forming apparatus according to claim 2, wherein the developing means has a function of recovering scratched toner remaining on the surface of the photosensitive drum.

4. The image forming apparatus according to claim 1, wherein the toner is non-magnetic single component toner.

* * * * *